United States Patent [19]

Winter et al.

[11] Patent Number: 5,020,439

[45] Date of Patent: Jun. 4, 1991

[54] PROJECTILE HAVING IMPROVED BASEPLUG

[75] Inventors: Joseph Winter, New Haven; Deepak Mahulikar, Meriden; Frank N. Mandigo, North Branford, all of Conn.

[73] Assignee: Olin Corporation, Cheshire, Conn.

[21] Appl. No.: 347,631

[22] Filed: May 5, 1989

[51] Int. Cl.[5] ..... F42B 12/04

[52] U.S. Cl. ..... 102/518; 102/473

[58] Field of Search ..... 102/334, 473, 501, 517, 102/518

[56] References Cited

U.S. PATENT DOCUMENTS

| | | | |
|---|---|---|---|
| 2,446,082 | 7/1948 | Dixon . | |
| 2,475,632 | 7/1949 | Moore et al. . | |
| 2,532,323 | 12/1950 | Miller, Jr. . | |
| 3,677,181 | 7/1972 | Giljarhus et al. | 102/52 |
| 3,946,673 | 3/1976 | Hayes . | |
| 3,992,996 | 11/1976 | Strandli | 102/56 R |
| 4,353,302 | 10/1982 | Strandli et al. | 102/364 |
| 4,384,528 | 5/1983 | Moore et al. . | |
| 4,444,112 | 4/1984 | Strandli et al. . | |
| 4,625,650 | 12/1986 | Bilsbury | 102/516 |

*Primary Examiner*—Deborah L. Kyle
*Assistant Examiner*—Richard W. Wendtland
*Attorney, Agent, or Firm*—H. Samuel Kieser

[57] ABSTRACT

A baseplug for a target-penetrating projectile containing an explosive in which the baseplug is fabricated in two components each preferably fabricated from a powdered pyrophoric material. The powdered pyrophoric material may be zirconium or titanium or alloys thereof which is charged with hydrogen which upon burning of the baseplug is released to increase the fine start capability of the projectile.

20 Claims, 2 Drawing Sheets

PROJECTILE HAVING IMPROVED BASEPLUG

The present invention generally relates to ordnance for destroying a target and, more particularly, is concerned with an improved baseplug for use with an ammunition projectile to provide exceptional accuracy, strength and tremendous destructive capability after target penetration and to the projectile provided therewith.

Armor-piercing, or target-penetrating, projectiles having an outer jacket and containing tandemly-arranged incendiary and explosive charges are conventional ordnance used in both offensive and defensive modes. Such projectiles are particularly effective when their destructive force is unleashed after they have penetrated the surface layers of the target. This is especially true for targets having electronic controls or computers susceptible to damage from metal fragments. Thus, it is common practice to incorporate some means for delaying ignition of the incendiary and/or explosive charges carried by the projectile until after impact. Representative of the prior art employing incendiary as a delaying initiator are the projectiles disclosed in Bilsbury U.S. Pat. No. 4,625,650, Giljarhus et al U.S. Pat. No. 3,677,181, Strandi U.S. Pat. No. 3,992,996 and Strandi et al U.S. Pat. No. 4,353,302.

The Bilsbury U.S. Pat. No. 4,625,650 patent relates to the early designs of the WALAP .50 caliber round from Olin Corporation (East Alton, Ill.), while the other three (Strandi, Strandi et al and Giljarhus et al) relate to the so-called "Multipurpose Rounds" from Olin Corporation.

With incendiary initiated explosive projectiles which are commonly called "HEI" (High Explosive Incendiary) or "PIE" (Pyrotechnically Initiated Explosive) rounds, the destructive force unleashed after impact and penetration of the target is ordinarily generated by detonation of the explosive charge which is contained in a metal body of the projectile rearward of a forwardly-located incendiary charge. The explosive charge is typically set off by a shock wave generated by ignition of the incendiary charge. Ignition of the incendiary charge in the projectile tip is caused by impact of the rapidly spinning projectile tip with the target. However, in the case of many prior art projectiles, except that in the Bilsbury U.S. Pat. No. 4,625,650, the duration of detonation of the explosive charge is relatively short and the magnitude and extent of its destructive impact suboptimal within the target. In the case of the projectile of U.S. Pat. No. 4,625,650, an optimum method of attaching the pyrophoric base plug is still needed.

As a result, a target-penetrating projectile has been proposed which has an explosive-containing, two-piece, cup-like assembly therein which enhances the destructive capability of the projectile after penetration of the target. The two-piece assembly includes an elongated cylindrical tungsten sheath which is open at its opposite forward and aft ends, and a cup-shaped pyrophoric metallic baseplug being closed at its aft end and open at its forward end. A baseplug is inserted into the aft end of the sheath to define an explosive-containing chamber therewith and is connected in a locking interfit with the sheath to adapt the chamber to prolong containment of explosive pressure build-up therewithin upon exploding of an explosive contained therein such that destructive fragmentation of the projectile after target penetration is delayed. The baseplug is composed of a pyrophoric metallic material which is capable of ignition by the build-up of explosive pressure and of prolonged burn after target penetration by the projectile.

The present invention provides an improved projectile having increased destructive impact after penetration of the target. The projectile includes an improved baseplug structure which is easy to manufacture and which, according to one form of the present invention, provides increased fire start capability and prolonged burn after target penetration and projectile fragmentation caused by the explosive pressure built-up for accomplishing ignition of fuels and other flammable materials within the target, thereby enhancing the destructive capability of the projectile after target penetration.

According to one embodiment of the invention baseplug structure comprises two components. The first component of the baseplug structure may comprise a generally frustoconical member having a bore extending therethrough. The second component may comprise a generally cup-shaped member having a flat aft portion and a forwardly extending, outwardly tapering side portion. The two members are adapted to be fit together with the narrow end of the first component being inserted into the second component with the outer side of the first component in an interlocking fit with the internal walls of the forwardly extending side of the second component.

According to another embodiment of the present invention, the baseplug structure may comprise a powdered pyrophoric material which has been pre-charged with hydrogen. The hydrogen will thermally discharge and be available for ignition as an amplification of the pyrophoric material.

According to the preferred embodiment, the baseplug structure may comprise two components having a tapered interlocking fit and which are fabricated from powders of zirconium or titanium and their alloys and which contain from about 5% to about 30% hydrogen.

The baseplug structure of the present invention may be used as a component of an explosive-containing assembly which is adapted for insertion within an outer jacket of a target-penetrating projectile. The explosive-containing assembly may include an elongated rearwardly inwardly flared, generally cylindrical, metallic sheath which is open at its opposite forward and aft ends and the baseplug structure which closed at its aft end and open at its forward end. The baseplug structure is inserted into the aft end of the sheath to define an explosive-containing chamber therewith and is connected in an obliquely locking interfit with the sheath to adapt the chamber to prolong containment of build-up of explosive pressure therewithin upon exploding of an explosive being contained therein such that the destructive capability of the projectile after target penetration is enhanced.

An assembled target-penetrating projectile may comprise an elongated outer metallic jacket having a tapered forward nose portion and a generally cylindrical main body portion and a cylindrical or tapered aft base portion, the portions being integrally connected together and defining a cavity. The explosive containing assembly is disposed within the cavity of the jacket in contact with the main body and aft base portions thereof. The explosive containing assembly is closed at its aft end and open at its forward end so as to define a chamber in communication with the cavity of the jacket at the nose portion thereof. An incendiary charge is contained within the nose portion of the jacket which is capable of igniting and generating a signal (such as a temperature rise or shock wave) upon impact of the nose portion of the jacket with a target. The explosive charge is contained within the chamber of the explosive containing assembly. The explosive charge is capable of exploding in response to the signal generated by the incendiary charge and of producing a build-up of explosive pressure within the assembly chamber which ultimately causes destructive fragmentation of the assembly and jacket.

These and other objects, features and advantages of the present invention will become apparent to those skilled in the art upon a reading of the following detailed description when taken in conjunction with the drawings wherein there is shown and described an illustrative embodiment of the invention.

In the course of the following detailed description, reference will be made to the attached drawings in which.

Figure 1:
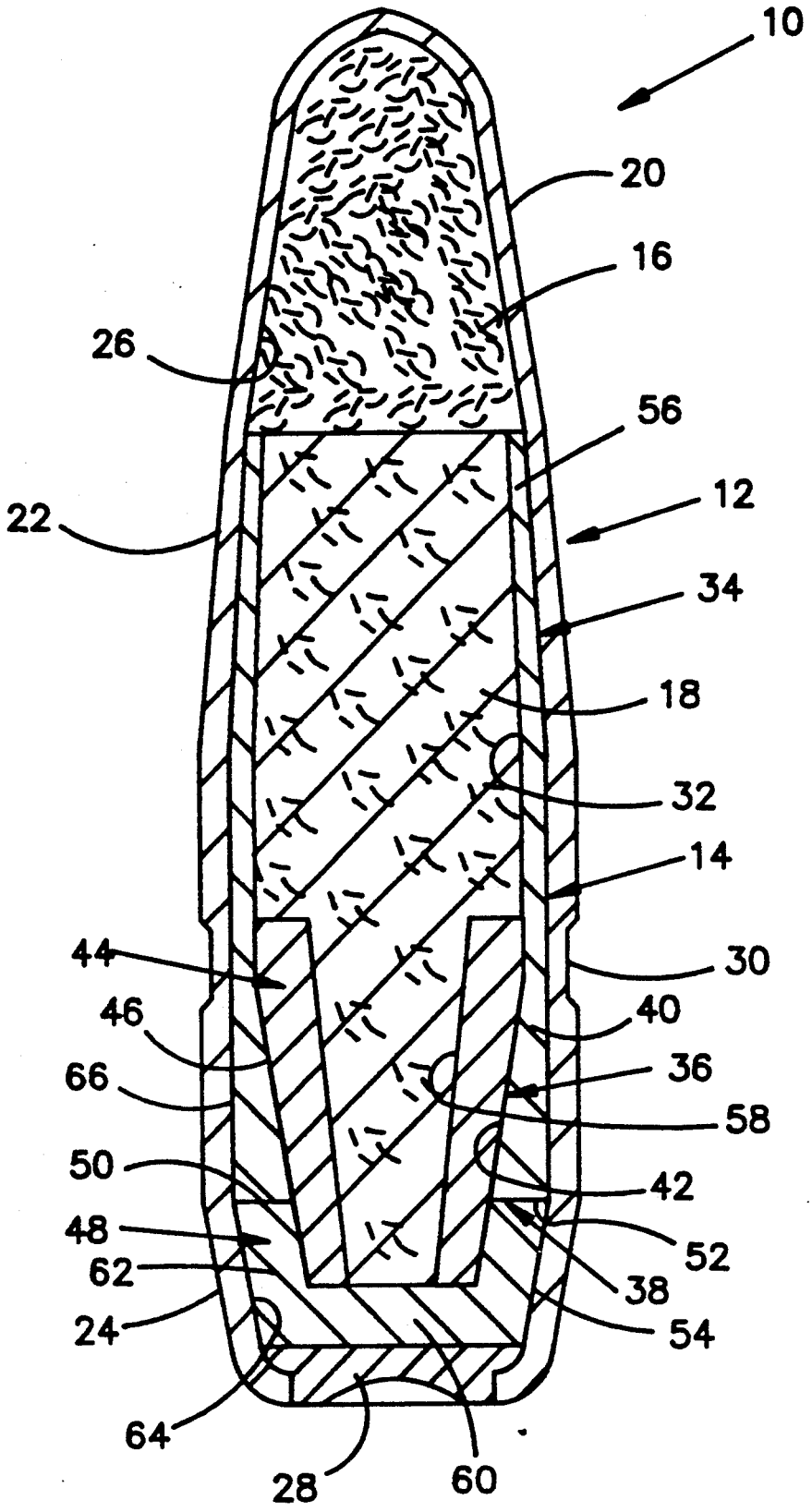
FIG. 1 is a longitudinal cross-sectional view of the improved projectile of the present invention, showing the improved baseplug of the present invention incorporated in a preferred fully assembled configuration.

Referring now to the drawings, and particularly FIG. 1, there is shown an assembled projectile having enhanced destructive capability after penetration of a target. The projectile is shown constructed in accordance with the present invention and is designated generally by the numeral 10. The projectile 10 basically includes an elongated outer tubular hollow jacket 12, an explosive-containing assembly 14, an incendiary charge 16 and an explosive charge 18.

More particularly, the jacket 12 is composed of a metallic material such as copper or brass and a sealing disk 28. The jacket 12 has an aerodynamically efficient tapered or conical forward nose portion 20, a generally cylindrical intermediate main body portion 22 and, preferably, an aerodynamically "boattail" tapered aft base portion 24. The nose, main body and base portions 20,22,24 respectively are integrally connected together and define a rearwardly open cavity 26 which is closed at the base portion by the sealing disk 28, formed from a suitable material such as lead. The base portion 24 of the jacket 12 is crimped around the periphery of and into the sealing disk 28. Also, an annular recess or cannelure 30 is formed about the exterior of the body portion 22 of the jacket 12 for facilitating attachment of the assembled projectile 10 to a cartridge case (not shown) during subsequent loading of the projectile 10 into the case to form a complete loaded ammunition round for launching the projectile through a rifled gun barrel of any suitable caliber, such as, for example, a .50 caliber M2HB machine gun.

The explosive containing assembly 14 is disposed within the cavity 26 of the jacket 12 and is in contact with the intermediate main body portion 22 and aft main base portion 24 thereof. The assembly 14 is closed at its aft end and open at its forward end so as to define a chamber 32 in communication with the cavity 26 of the jacket 12 at its forward nose portion 20.

More particularly, the explosive charge containing assembly 14 is made up of an elongated generally cylindrical hollow metallic sleeve (preferably of heavy metal) or sheath 34 open at its opposite forward and aft ends, and a hollow (preferably cup-shaped) baseplug structure 36 closed at its aft end and open at its forward end. The baseplug structure 36 is inserted in the open aft end of the sheath 34 to define the chamber 32 therewith and is connected with an interlocking fit as indicated at 38 with the sheath 34 to adapt the chamber 32, which receives and contains the explosive charge 18, to prolong containment of the explosive pressure therewithin upon exploding of the explosive charge 18 so that the destructive capability of the projectile 10 after target penetration is substantially enhanced.

The sheath 34 at an aft portion 40 thereof has a continuous annular interior longitudinal surface 42 which tapers inward in an aft direction when in the assembled condition. The baseplug structure 36 at a forward portion 44 thereof has a continuous annular exterior surface 46 of a tapered configuration which tapers outwardly in a forward direction. The tapered configuration of the baseplug structure forward exterior surface 46 is complementary to the tapered configuration of the sheath aft portion interior surface 42 when assembled so as to provide the aforementioned locking interfit 38 between the sheath and the baseplug structure 36 which holds the baseplug structure to the sheath 34 against the explosive force of the explosive charge 18 contained in the chamber 32 of the assembly 14.

In addition to its forward portion 44, the baseplug structure 36 has an aft portion 48 connected to the forward portion 44. The aft portion 48 has a continuous annular forward end surface forming a ledge 50 which faces in the forward direction. Also, in addition to the interior longitudinal surface 42 on its aft portion 40, the sheath has a continuous annular aft facing end surface 52 on its aft portion 40. The sheath end surface 52 and sheath interior longitudinal surface 42 respectively abut the forward surface of ledge 50 of the baseplug structure and the baseplug forward portion exterior side surface 6 in the locking interfit 38 of the sheath with the baseplug structure 36. Further, the baseplug aft portion 48 is provided with a continuous annular exterior side surface 54 which tapers outwardly in a forward direction as to define an aerodynamically efficient boattail exterior shape for the base portion 24 of the outer jacket. Finally, the sheath 34 at a forward portion 56 thereof is preferably forwardly and inwardly tapered to conform to and give a smooth aerodynamic ogive at the nose portion 20 of the outer jacket 12.

It will be realized that the tungsten sheath 34 is characterized in its final shape by inwardly tapered configurations at the interior of its aft and forward portions 40 and 56 respectively. The taper at the forward portion of the sheath conforms to the ogive of the jacket 12. The rear or aft taper, as will become more apparent below, is made by a post forming operation, which swages or squeezes the heavier aft portion 40 of the sheath 34 around the forwardly flared forward portion 44 of the baseplug structure 36. The two flared portions of the sheath and baseplug connect them together into the assembly 14, making the connection strong in shear (resistance to rotational slippage during spin-up) and permit optimum pressure build-up (containment) during initial target penetration to maintain minimum projectile diameter during that penetration and to increase the pressure at which fragments are laterally propelled during subsequent disintegration and fragmentation of the metallic parts of the projectile.

The incendiary charge 16 of the projectile 10 is contained within the nose portion 20 of the jacket 12. The incendiary charge 16 is capable of igniting and generating a shock wave upon impact of the jacket nose portion 20 with the target. The explosive charge 18 is contained within the chamber 32 of the assembly 14. The explosive charge 18 is capable of exploding in response to the shock wave generated by the incendiary charge 16 and of producing a build-up of explosive pressure within the assembly chamber 32 which ultimately causes destructive fragmentation of the assembly 14 and jacket 12 as explained above, and to prevent the explosive pressure from being expelled through the weaker pyrophoric material instead of through the tungsten body. The incendiary and explosive charges 16 and 18 respectively can be made of any suitable materials.

Figure 2:
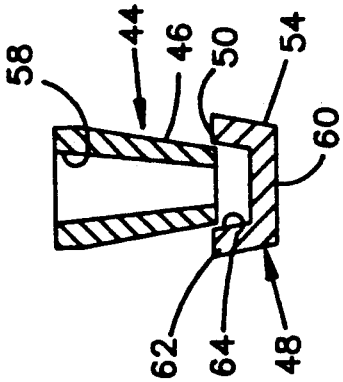
FIG. 2 is a longitudinal cross-section view of the two components of the baseplug prior to their being assembled together.

According to one feature of the invention, the baseplug structure is fabricated from two components, the first component comprises the forward portion 44 and is generally frusto-conical providing the exterior surface 46 of tapered configuration, A bore 58 extends at least partially through the first component from the forward end thereof, and preferably all the way through as shown is FIG. 2. The second component comprises the aft portion 48 and is a generally cup-shaped member having a flat aft portion 60 and a forwardly extending outwardly tapering wall portion 62 having an forwardly and outwardly tapering inner surface 64 of complimentary configuration to the tapering aft portion of the exterior surface 46 of the first component.

The two components 44 and 48 forming the baseplug structure 36 are adapted to be connected together with the narrow aft end of the first component 44 being inserted into the second component 48 with the exterior surface 46 of the first component being in an interlocking fit with the inner surface 64 of the wall portion of the second component by virtue of the complementary tapers. The forward end of the second component 48 forms the ledge 50 of the base plug structure 36.

Both components of the baseplug structure according to this embodiment of the invention may be fabricated from powdered pyrophoric material. Preferably, the material may be selected from the group consisting of magnesium, aluminum, misch metal, titanium, zirconium, their alloy and mixtures thereof. The components of the baseplug may be fabricated using conventional powder metallurgical techniques. Such techniques may include cold compacting or isostatic pressing followed by suitable annealing. By making the baseplug structure 36 in two components from powdered materials, its manufacture is simplified. The need for extensive machining is reduced, and the problem of re-entrant angles, due to the various tapers is overcome.

According to another embodiment, the fire start capability of the baseplug may be further enhanced by fabricating the components from powdered zirconium or titanium or their alloys or mixtures thereof and prechanging them with hydrogen. These elements are able to store very large quantities of hydrogen by formation of metal hydrides. A unique characteristic of this process is that it is completely reversible with temperature. That is, hydrogen can be charged in an appropriate anneal, and the hydrogen will discharge with an elevated temperature excursion.

The components of the baseplug, according to this embodiment, are powder pressed to a density of less than 100% and preferably to about 60% to about 80% density. The components are then vacuum sintered at a temperature of from about 950° C. to about 1300° C. The sintering should be for at least 30 minutes and preferably about 3 hours. After sintering, the components are annealed in an activated hydrogen containing environment to temperatures of 300° to 900° C. depending upon time, which may be from about 1 to about 24 hours. The hydrogen containing environment may be one containing a mixture of nitrogen and hydrogen as for example, 96% by volume nitrogen, 4% by volume hydrogen. The density of the pressed components, as well as the time and temperature of the anneal should be such as to charge the components with about 5 to about 30% by volume hydrogen. If necessary, the components may be cold coined, or otherwise machined to final size. It has been found that the sintering prior to hydrogen charging is critical. Without the sintering step, the components, after being charged with hydrogen, loose their mechanical integrity and crack and disintegrate.

With the addition of hydrogen to the baseplug material as described above, in use, when the baseplug material is ignited after impact upon a target, large amounts of hydrogen gas will be released which will significantly increase the fine start capability of the rounds. While it is preferred to manufacture the hydrogen charged baseplug structure in the form of two components, it is to be understood that the baseplug structure of hydrogen charged pyrophoric material may be fabricated in one piece.

Referring now to FIGS. 2–6, there is illustrated the steps in the method of assembling the projectile 10. As shown in FIG. 2, if the base plug assembly 36 is in the form of two components, it may be assembled by inserting the smaller tapered aft end of the frustoconical member into the dish shaped member so that the tapered surfaces 46 and 64 respectively engage in an interlocking fit.

The tungsten sheath 34 is provided by any suitable conventional fabrication process. However, the configuration of the sheath 34 before connection with the baseplug assembly 36 is somewhat different than after connection therewith. Both before and after connection with the baseplug assembly 36, the wall section at the sheath aft portion 40 is greater in thickness than the remaining portion thereof. However, before connection with the baseplug assembly 36, the interior surface of the sheath aft portion 40 bounding the inside of the wall section is of generally cylindrical configuration, whereas the exterior surface 66 (which is generally cylindrical in the assembly 14) is of an outwardly and rearwardly flared configuration. Thus, the thickness of the aft portion wall section increases progressively on its exterior toward the aft end of the sheath 34. The sheath 34 is also provided by the conventional fabrication process with its forwardly and inwardly tapered forward portion 56 which defines a wall section having forwardly and inwardly tapered exterior and interior surfaces which will conform to an interior surface of the projectile ogive.

Figure 4:
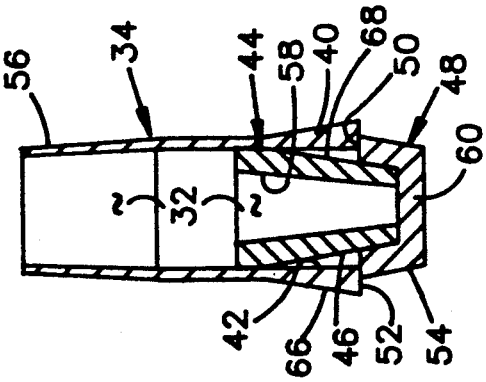
FIG. 4 is a longitudinal cross-sectional view of the sheath and baseplug of the assembly, illustrating the same after being partially assembled together with the configuration of the sheath the same as in FIG. 2.
Figure 3:
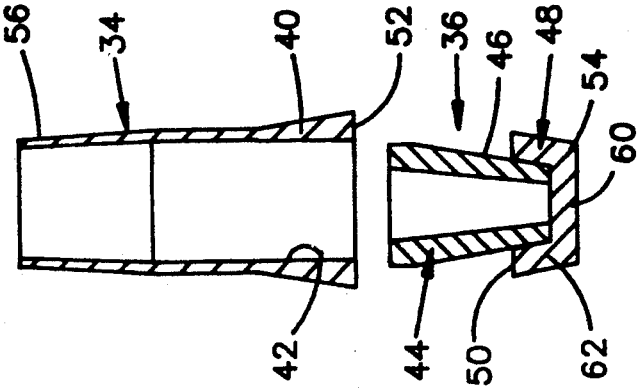
FIG. 3 is a longitudinal cross-section view of the metallic sheath and the assembled two-component baseplug of the explosive containing assembly, illustrating the sheath and baseplug prior to being assembled together and the configuration of the sheath before being formed to provide a locking interfit with the baseplug.

As seen in FIG. 4, the forward portion 44 of the baseplug 36 is smaller in diameter than the inside diameter of the sheath aft portion 40 which adapts the baseplug structure 36 to fit into the aft end of the sheath 34 and define the explosive-receiving chamber 32 therewith. The inwardly and rearwardly tapered exterior surface 46 on the forward portion 44 of the baseplug structure 36 defines a generally annular conical space 68 between it and the sheath aft portion interior surface 42 when the baseplug assembly 36 is inserted into the sheath 34. After insertion of the baseplug assembly 36 into the aft end of the tungsten sheath 34 as shown in FIG. 4, the aft portion 40 of the sheath 34 may then be pushed inwardly or reformed by any suitable process, such as swaging, so as to eliminate the rearwardly and outwardly flared configuration of the exterior surface 58 thereof and produce the rearwardly and inwardly tapered configuration on the interior surface thereof. The reforming operation causes the sheath aft portion 40 to fill the space 68 and assemble the sheath 34 and baseplug 36 into the assembled two-piece assembly 14 of FIG. 5 with the locking interfit 38 connecting the sheath aft portion 30 and the forward portion 44 of the baseplug structure 36 together.

Figure 6:
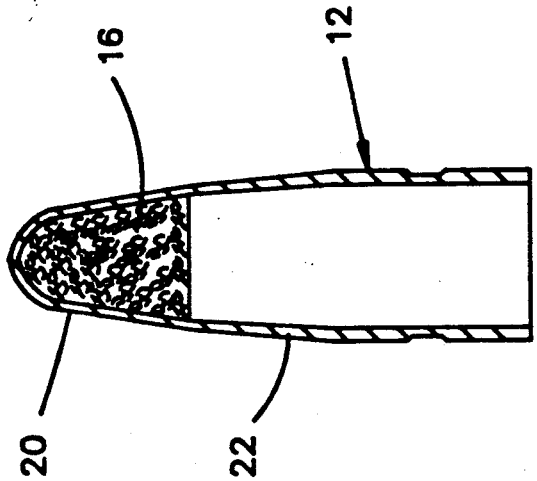
FIG. 6 is a longitudinal cross-sectional view of a metallic jacket with an incendiary charge contained in its nose and of the assembled sheath and baseplug with a high explosive charge contained therein, illustrating the jacket and explosive filled ("loaded") two-piece assembly prior to being assembled together to provide the improved projectile of FIG. 1.
Figure 6:
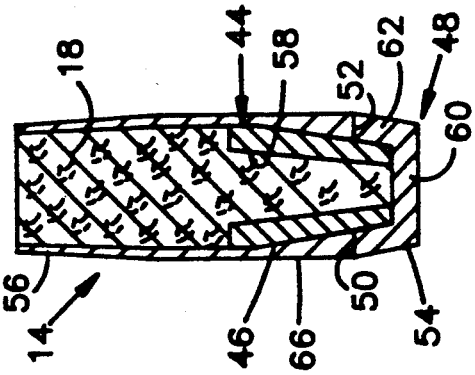
Figure 5:
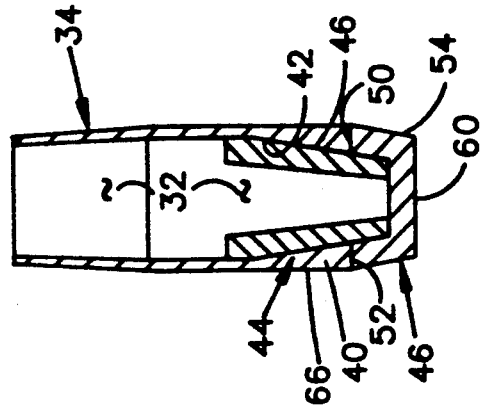
FIG. 5 is a longitudinal cross-sectional view of the sheath and baseplug of the assembly, illustrating the same after being assembled together and the configuration of the sheath after being formed to provide a locking interfit with the baseplug.

Before insertion of the explosive containing assembly 14 into the aft end of the outer jacket 12, the chamber 38 of the two-piece assembly 14 is fitted with the explosive charge 18, as shown in FIG. 6. Also the jacket nose portion 20 is filled with the incendiary charge 16. The assembled explosive containing assembly 14 may then be inserted sheath-first into the cavity 26 of the outer jacket 12 through its open aft end. Thereafter, the lead sealing disk 28 is positioned against the aft end of the baseplug assembly 36 and the aft end of the outer jacket 12 is crimped around the peripheries of the aft end of the assembled explosive containing assembly 14 and disk 28.

In use, when the projectile of the present invention is launched and impacts a light-armoured target, such as an aircraft of helicopter, the incendiary mix or charge 16 located in the forward nose portion 20 of the projectile is ignited. The ignition of the incendiary charge 16 over a delay period generates a shock wave which after the delay sets off the high explosive charge 18 within the projectile 10. The pressure builds up within the projectile 10 and the explosive containing assembly 14 therein. Ultimately, the pressure exceeds the ultimate strength of the jacket 12 and assembly 14. However the construction of the assembly 14 prolongs the time until this point is reached. As the explosion progresses causing the parts to fragment and move forwardly and laterally through the target, the material of the baseplug assembly 36 begins to burn. The burning of this material persists or is prolonged enough to give added likelihood that the projectile can ignite flammable material within the target which otherwise would not be set off by the brief explosion of the explosive charge 18. The release of hydrogen from the hydrogen charged baseplug structure as it burns aids in the ignition of the flammable material.

The U.S. patents set forth in this specification are intended to be incorporated by reference herein in their entirety.

It is apparent that there has been provided in accordance with this invention an improved baseplug assembly and projectile which satisfies the objects, means and advantages set forth hereinbefore. While the invention has been described in connection with a specific embodiment thereof, it is evident that any alternative, modifications and variations will be apparent to those skilled in the art in light of the foregoing description. Accordingly, it is intended to cover all such alternatives, modifications and variations as fall within the spirit and broad scope of the appended claims.

What is claimed is:

1. A baseplug for a target-penetrating projectile containing an explosive charge, said baseplug comprising:

at least a first and second member;

said first member being substantially frustoconical and having a bore extending from its forward end at least a portion of the way therethrough;

said second member being cup-shaped and having an aft end and a forward extending wall portion, said wall portion having an internal surface tapering forwardly and outwardly;

said first member having its aft end received within the opening defined by the wall portion of said second member, said internal surface of said second member being in the mating engagement with the external surface of the aft end of said first member; and said first and second member comprising from about 5 to about 30% volume hydrogen.

2. The baseplug of claim 1 wherein said bore in said first member extends through said first member.

3. The baseplug of claim 1 wherein said first and second member are comprises of a pyrophoric material selected from the group consisting of magnesium, aluminum, misch metal, titanium, zirconium, their alloys and mixtures thereof.

4. The baseplug if claim 3 wherein said material is a powdered material.

5. The baseplug according to claim 1 wherein said forward end of said first member is adapted to be connected to the aft end of a sheath of a target-penetrating projectile to define an explosive-containing chamber therewith by an oblique locking interfit with the sheath.

6. An explosive-containing assembly for insertion within an outer jacket of a target-penetrating projectile, the assembly comprising;

an elongated generally cylindrical metallic sheath being open at its opposite forward and aft ends; and a cup-shaped baseplug being closed at its aft end and open at its forward end, the baseplug being inserted into the aft end of the sheath to define an explosive-containing chamber therewith and being connected in an oblique locking interfit with the sheath, said baseplug being formed from a powdered pyrophoric material and containing hydrogen.

7. The assembly of claim 6 wherein said baseplug is fabricated from powders of zirconium, titanium, their alloys or mixtures thereof and contains from about 5% to about 30% hydrogen.

8. The assembly of claim 7 wherein said baseplug comprises two members, said first member being substantially frustoconical and having a bore extending therethrough, said second member being cup-shaped with a closed aft portion and a forwardly extending sidewall having an internal surface tapering forwardly and outwardly, said first member having its aft portion received within the sidewall, said internal taper of said sidewall being complimentary to the taper of the aft end of said first member to provide a locking interfit.

9. The assembly of claim 8 wherein said sheath at an aft portion thereof has a rearwardly inwardly tapering interior surface and the first member of said baseplug has a forward portion having a forwardly and outwardly tapering exterior surface complimentary to the taper surface of the sheath aft portion to provide the locking interfit between the sheath and the baseplug structure.

10. The assembly of claim 9 wherein the forward end of said second member of said baseplug forms a ledge against which the aft end of the sheath abuts.

11. A baseplug for a target-penetrating projectile containing an explosive charge, said baseplug comprising:

at least a first and second member;

said first member being substantially frustoconical and having a bore extending from its forward end at least a portion of the way therethrough;

said second member being cup-shaped and having an aft end and a forward extending wall portion, said wall portion having an internal surface tapering forwardly and outwardly;

said first member having its aft end received within the opening defined by the wall portion of said second member, said internal surface of said second member being in the mating engagement with the external surface of the aft end of said first member; and said first and second member being comprised of a material selected from the group consisting of zirconium, titanium, alloys thereof, and mixtures thereof, said first and second members further containing hydrogen.

12. The baseplug of claim 11 wherein said first and second members contain from about 5% to about 30% by volume hydrogen.

13. The baseplug of claim 11 wherein said material is a powdered material.

14. A baseplug for a target-penetrating projectile containing an explosive, the baseplug comprising:

a cup-shaped member being closed at its aft end and open at its forward end, said baseplug being a pyrophoric material containing hydrogen.

15. The baseplug of claim 14 wherein said baseplug is a powdered material selected from the group consisting of zirconium, titanium, alloys thereof, and mixtures thereof, said baseplug further containing hydrogen.

16. The baseplug of claim 15 wherein said hydrogen comprises from about 5% to about 30% by volume of said baseplug.

17. A target-penetrating projectile with enhanced destructive capability after penetration of the target, comprising:

an elongated outer metallic jacket having forward and aft ends and defining a cavity extending therebetween;

an explosive containing assembly disposed within the cavity of the jacket and spaced from the forward end of the jacket, the assembly being closed at its aft end and open at its forward end so as to define a chamber in communication with the cavity of the jacket at the forward end thereof;

an incendiary charge contained within the cavity at the forward end of the jacket, the incendiary charge capable of igniting and generating a signal upon impact of the forward end of the jacket with the target; and an explosive charge contained within the chamber of the cup-like assembly, the explosive charge capable of exploding in response to the signal generated by the incendiary charge and of producing a build-up of explosive pressure within the assembly chamber which ultimately causes destructive fragmentation of the assembly and jacket;

said assembly including a generally cylindrical tungsten sheath and a baseplug structure, an interior surface of an aft portion of the sheath and an exterior surface of a forward portion of said baseplug structure having complimentary tapered configurations providing a locking interfit therebetween, the baseplug being composed of a powdered pyrophoric material capable of ignition by the buildup of explosive pressure and of prolonged burn after target penetration and containing hydrogen which is releasable upon burning of the pyrophoric material.

18. The projectile of claim 17 wherein said pyrophoric material is selected from the group consisting of zirconium, titanium, alloys thereof and mixtures thereof.

19. The projectile of claim 18 wherein said baseplug comprises about 5% to about 30% by volume hydrogen.

20. An explosive-containing assembly for insertion within an outer jacket of a target penetrating projectile, the assembly comprising:

an elongated generally cylindrical metal sheath being open at its opposite forward and aft ends;

a cup-shaped baseplug being closed at its aft end and open at its forward end, the baseplug being inserted into the aft end of the sheath to define an explosive-containing chamber therewith, said baseplug including at least a first and a second member;

said first member having an exterior surface which is substantially frusto conical and having a bore extending from its forward end at least a portion of the way therethrough;

said second member being cup-shaped and having an aft end and a forward extending wall portion defining an opening in said second member, said wall portion having an internal surface tapering forwardly and outwardly;

said first member having its aft end received within the opening defined by the wall portion of said second member, said internal surface of said second member being in mating engagement with the external surface of the aft end of said first member; and the forward end of said first member being connected to the aft end of the sheath by an oblique locking interfit with the sheath.

* * * * *